United States Patent [19]

Hopmann et al.

[11] Patent Number: 4,949,791

[45] Date of Patent: Aug. 21, 1990

[54] METHOD AND APPARATUS FOR SECURING AND RELEASING CONTINUOUS TUBING IN A SUBTERRANEAN WELL

[75] Inventors: Mark E. Hopmann, Broken Arrow; Douglas J. Murray; Scott C. Strattan, both of Tulsa, all of Okla.

[73] Assignee: Baker Hughes Incorporated, Houston, Tex.

[21] Appl. No.: 308,887

[22] Filed: Feb. 9, 1989

[51] Int. Cl.[5] ..... E21B 19/16; E21B 19/22

[52] U.S. Cl. ..... 166/378; 166/77.5; 166/85; 166/380; 285/323

[58] Field of Search ..... 166/378–381, 166/384, 77, 77.5, 85, 242; 285/3, 104, 105, 322, 323, 339, 341, 922

[56] References Cited

U.S. PATENT DOCUMENTS

| | | | |
|---|---|---|---|
| 3,037,797 | 6/1962 | Brown | 285/922 |
| 3,248,135 | 4/1966 | Meripol | 285/323 |
| 3,912,014 | 10/1975 | Wetzel | 166/384 |
| 4,431,216 | 2/1984 | Legris | 285/323 |
| 4,452,472 | 6/1984 | Crase | 285/922 |
| 4,515,220 | 5/1985 | Sizer et al. | 166/384 |
| 4,712,813 | 12/1987 | Passerell et al. | 285/323 |

*Primary Examiner*—Bruce M. Kisliuk

*Attorney, Agent, or Firm*—Hubbard, Thurman, Turner, Tucker

[57] ABSTRACT

An apparatus is provided for securement onto one end of a continuous length of remedial tubing introducable into a subterranean well and concentrically insertable through production tubing previously positioned within said well, said remedial tubing having a pre-determined tensile strength. In one embodiment, the apparatus comprises inner and outer cylindrical housing members having an opening for receipt of the remedial tubing. A first element on one of the housings has a first tapered surface decreasing in internal diameter from a first end away from the opening to a second end toward the opening. Gripping means are provided and are housed within the surface and have a second tapered surface in companion contoured relationship with the first tapered surface for engagement with the remedial tubing and movable along the first tapered surface, whereby tensile load applied through the remedial tubing and the decrease of the diameter of the first and second tapered surfaces will urge the gripping means into further radially axial engagement with the remedial tubing the housing and the gripping means having a tensile strength in excess of the tensile strength of the remedial tubing. A method of utilization of the device is also disclosed, as well as an apparatus and method for completing a substantially horizontal or deviated section of a subterranean well.

23 Claims, 2 Drawing Sheets

METHOD AND APPARATUS FOR SECURING AND RELEASING CONTINUOUS TUBING IN A SUBTERRANEAN WELL

BACKGROUND OF THE INVENTION

1. Field of the Invention

The invention relates to an apparatus for affixation of tools onto the end of continuous remedial tubing introduced through production tubing, such as that utilized to complete a substantially horizontal section of a deviated subterranean well portion.

2. Description of the Prior Art

In the past, those skilled in the art relating to remedial operations associated with the drilling, production and completion of subterranean oil and gas wells have relied on conventional "snubbing" or hydraulic workover units which utilize threaded or coupled remedial tubing normally inserted through production tubing for use in operations, such as perforating, acidizing and fracturing, corrosion control, pressure testing of tubular goods and vessels, cementing, clean out operations, sand bridge removal, storm value recovery, insertion of kill strings, wireline fishing tools, and the like.

Continuous coiled remedial tubing and injectors for use therewith have contributed substantially to conventional remedial tubing operations. For example, coiled tubing, being continuous, can be inserted into the well faster than threaded and coupled tubing which is furnished in relatively short sections that must be screwed together. In addition, it is easier, when required, to pass continuous tubing through stuffing boxes and blowout preventers because its external diameter is consistently the same size and not interrupted periodically by couplings. The coiled remedial tubing normally is made of steel and is commercially available in sizes from 0.75 inch o.d. through 1.315 inch o.d., but may have a smaller or larger diameter.

Typical of such remedial coiled tubing and injectors is that generally described in U.S. Pat. No. 3,182,877. The apparatus is commercially referred to as the "Bowen Continuous Spring Tubing Injector Unit" and basically comprises a hydraulically powered injector unit which feeds a continuous remedial tubing string from a coiled or "spooled" workstring contained on a powered and generally portable reel unit into the wellhead by means of two opposed, endless, rotating traction members. Such a reel unit is generally described in U.S. Pat. No. 3,614,019. The upper end of the string which remains on the reel is conventionally connected to the hollow shaft of the reel which permits a liquid or a gas to be pumped through the coiled remedial tubing string by means of a swivel connection. The injector and reel are normally mounted on a single transportable skid, a trailer, or, alternatively, may be componently arranged on skids to facilitate convenient offshore use.

To inject remedial coiled tubing, the injector is arranged on or above the wellhead. The reel unit, containing up to approximately 15,000 feet of continuous coiled metal remedial tubing, is located preferably about 15 to 20 feet from the wellhead. The remedial coiled tubing is brought from the reel in a smooth arc loop through the injector unit and into the well through pressure retention and control equipment.

For many years the desirability of utilizing a subterranean wellbore having a non-vertical or horizontal portion traversing a production formation has been known and appreciated in the prior art. Laterally directed bores are drilled radially, usually horizontally from the primary vertical wellbore, in order to increase contact with the production formation. Most production formations have a substantial horizontal portion and, when conventional vertical wellbores are employed to tap such production formations, a large number of vertical bores must be employed. With the drilling of a wellbore having a non-vertical or horizontal portion traversing the production formation, a much greater area of the production formation may be traversed by the wellbore and the total field of drilling costs may be substantially decreased. Additionally, after a particular horizontal wellbore has produced all of the economically available hydrocarbons, the same vertical wellbore may be redrilled to establish another horizontal portion extending in another direction and thus prolong the utility of the vertical portion of the well and increase the productivity of the well to include the total production formation.

By use of and reference to the phrase "wellbore" herein, it is intended to include both cased and uncased wells. When uncased wells are completed, the bore hole wall defines the maximum hole diameter at a given location. When cased wells are completed, the "wall" of the well will be the internal diameter of the casing conduit.

By use of the phrase "deviated well" and "deviated wellbore", it is meant to refer to wells and wellbores which comprise a vertical entry section communicating through a relatively short radius curvature portion with a non-vertical or horizontal portion communicating with the production formation. In most instances, the production formation extends for a substantial horizontal extent and the generally linear well-bore portion traverses a substantial horizontal extent of the production formation, at least up to a distance of 1000 to 2000 feet, or more. The radius portion of the wellbore has a curvature of at least 10° per 100 feet of length, and preferably a curvature lying in the range of 10° to 30° per 100 feet of length.

In such deviated wellbores, particularly those having the longer lengths, it is difficult, if not impossible, to activate completion equipment, such as shifting tools for opening and closing sleeves, activating wash tools, and the like, by means of conventional electric or piano wireline means, which are disposed through the production tubing which, in turn, has been implaced within the well section through casing (assuming that the well is encased), or, alternatively, through open hole (if the well is not so encased).

As the well section becomes more deviated, the weight suspended from the wireline will become insufficient to actuate the tool, or, at least, to properly position it at the desired location within the deviated portion of the well. Such tools can thus be expected to become improperly lodged or unpositionable within such well. Accordingly, remedial continuous coiled tubing can be utilized to perform operations in such wells heretofore practiced by application of wireline actuated devices. Such tubing requires the devices to be fixed at its lowermost end inserted within the wellbore. In the past, such tools have been affixed by merely crimping the end of the tubing onto the tool. Such procedure has the disadvantage of not having sufficient tensile strength, in many instances, at least equal to that of the tubing, whereby the connection becomes the weakest length between the tubing and the tools inserted thereon.

It is therefore desirable to provide an apparatus for securement onto the end of continuous remedial coiled tubing, particularly in applications for the completion of deviated holes in horizontal completion techniques, whereby the connection exceeds the tensile strength of the remedial tubing itself, such that the connection is not the weakest point in the tubing and the apparatus is carried thereon. To assure that such securing apparatus and the continuous coiled tubing can be conveniently released from tools carried below the securing apparatus at one end thereof, means for quickly releasing the tubing for ultimate retrieval to the top of the well are also provided.

SUMMARY OF THE INVENTION

The invention provides a method and apparatus for securement onto one end of a continuous length of remedial tubing introducable into a subterranean well and concentrically insertable through the production tubing previously positioned within a well, such as at a deviated portion of a horizontally drilled well. The remedial tubing has a pre-determined tensile strength. The apparatus comprises inner and outer cylindrical housing members having an opening therethrough for receipt of one end of the remedial tubing. A first element of one of the housings has a first tapered surface thereon, the first tapered surface decreasing in internal diameter from a first end away from the opening to a second end toward the opening. Gripping means are housed within the surface and have a second tapered surface in companion contoured relationship with the first tapered surface for engagement with the remedial tubing and movable along the first tapered surface whereby the tensile load applied through the remedial tubing and the decrease of the diameter of the first and second tapered surfaces will urge the gripping means into further radially axial engagement with the remedial tubing, the housings and the gripping means having a tensile strength in excess of the tensile strength of the remedial tubing. Releasing means are also provided in the apparatus, which are preferably hydraulically activated.

DESCRIPTION OF THE PREFERRED EMBODIMENTS

Figure 1:
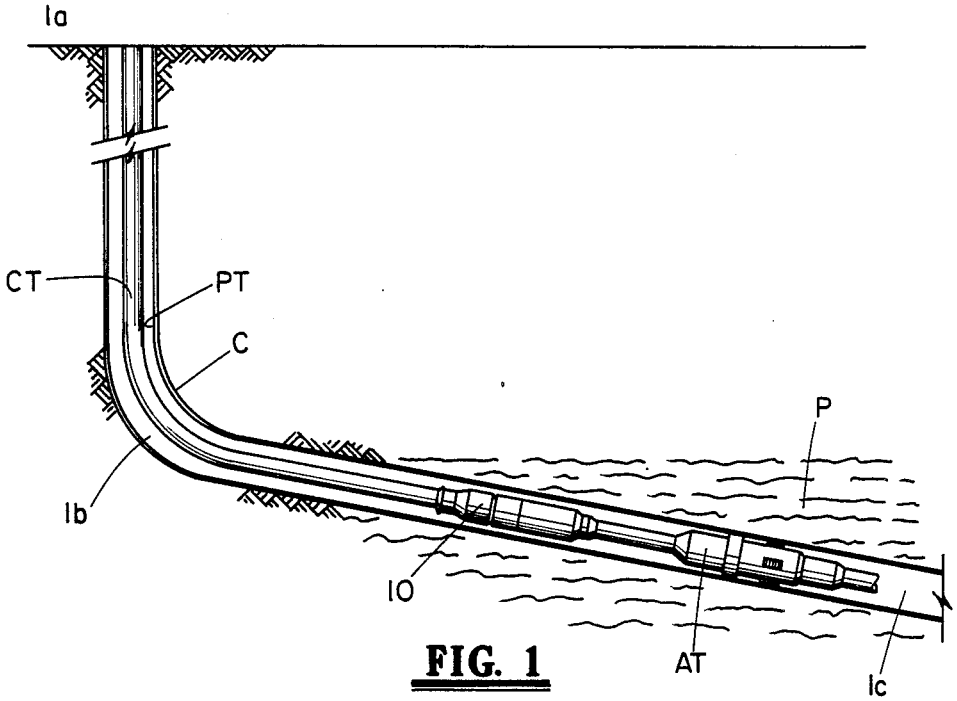
FIG. 1 is a schematic illustration of a deviated portion of a subterranean well, with casing, production tubing and coiled tubing inserted therethrough, with the securing means of the present invention on the coiled tubing.

Referring to FIG. 1, there is shown a deviated wellbore of the type for which this invention is particularly useful. Such wellbore comprises a vertical entry section 1a communicating through a relatively short radius curvature portion 1c with a non-vertical or horizontal portion 1c communicating with the production formation P.

The well is shown encased by casing C through which is positioned production tubing PT which, in turn, has inserted therethrough a continuous length of remedial coiled tubing CT at the lower end of which has the securing apparatus 10 affixed thereon, with an auxilary tool AT carried at the other end of the securing apparatus 10.

Figure 2:
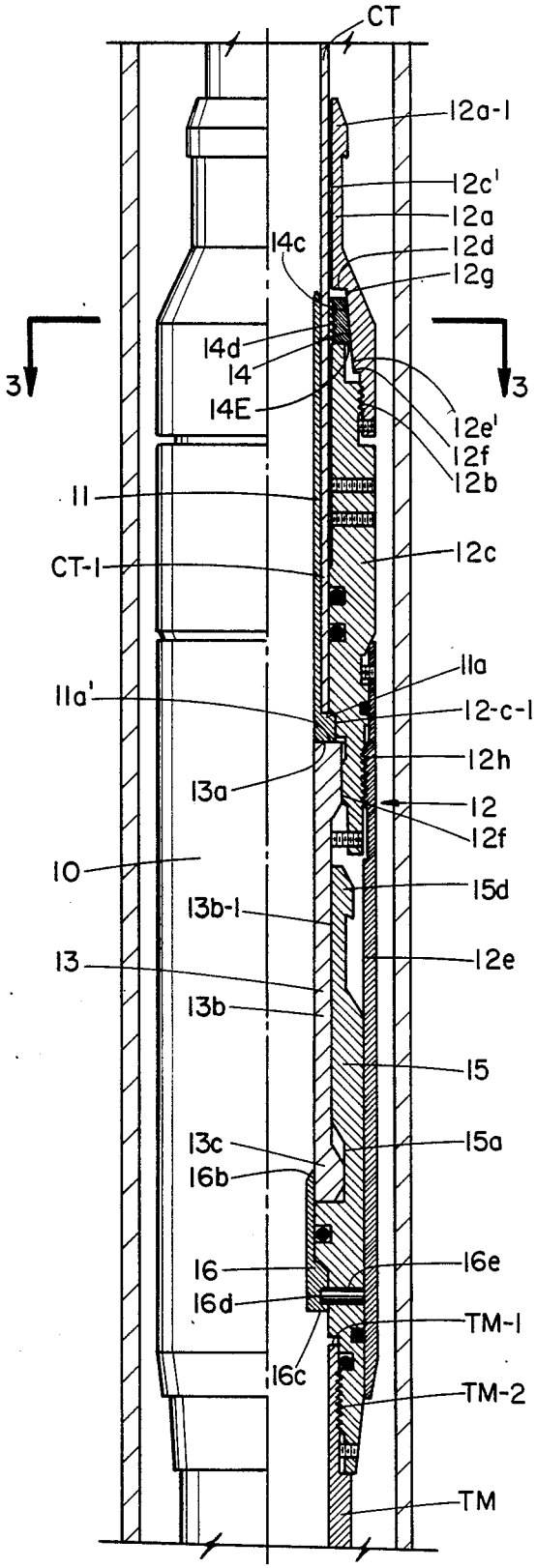
FIG. 2 is a longitudinal sectional view of the apparatus of the present invention within the well portion shown in FIG. 1.

Now referring to FIG. 2, the apparatus 10 is shown with one end CT-1 of a continuous length of coiled tubing CT implaced within a longitudinally extending inner cylindrical housing member 11 and an outer cylindrical housing 12. The outer housing 12 is, in turn, comprised of an upper fishing neck element 12a having means 12a-1 for securing a fishing tool, or other retrieving device, to the apparatus 10 to remove same from the well, in customary fashion. The fishing neck element 12a is secured internally at its lowermost end by means of threads 12-b to a central cylindrical housing member 12-c which, in turn, is threadably connected at threads 12-b to a cylindrical lower housing member 12-e. Also secured internally at the lowermost end of the central housing member 12c at threads 12-f is locking means 13.

As shown in FIG. 2, one end CT-1 of the coiled tubing CT is shown positioned between the inner and outer housing members 11, 12. The end CT-1 abuts an outwardly facing circumferentially extending shoulder 11-a partially received within a companion slot 12c-1 of the central housing 12-c. The inner housing 11 is maintained in place within the slot 12-c-1 by the interengagement of the lower face 11-a$^1$ of the shoulder 11a with upper face 13-a of the locking means 13.

The fishing neck element 12a has an inwardly facing circumferentially extending upper longitudinal smooth surface 12-c' terminating at its lower end in an abutment shoulder 12-d extending inwardly into the fishing neck element 12-a which, in turn, provides the uppermost end of a tapered surface 12-e' having an enlarged internal diameter portion at its lower end 12-f and extending upardly to a tapered end surface 12-g. The extent of the taper between 12f, 12g enlarges as the taper progresses downwardly on the fishing neck element 12a. Correspondingly, the internal diameter of the tapered surface defined by 12f, 12g, recedes as the taper extends upwardly along the fishing neck element 12-a.

Figure 3:
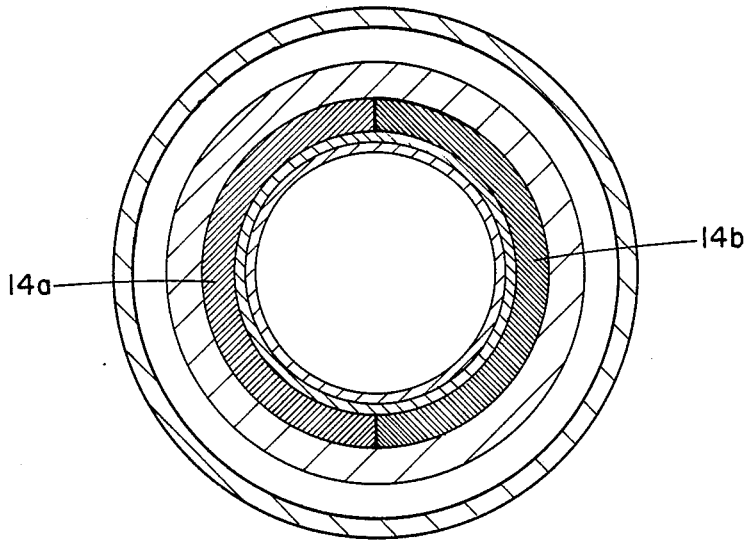
FIG. 3 is a sectional view taken along lines 3–3 of FIG. 2.

Housed interiorly of the fishing neck element 12a is the gripping means 14. As shown in FIG. 3, gripping means 14 is comprised of companion circumferentially extending wedge sections 14a, 14b, (FIG. 3) which are implaced within the interior of the fishing neck element 12a. The gripping means 14 has a exterior second tapered surface 14c for companion tapering movement with the surface on the fishing neck element 12a defined by the surface portions 12f, 12g. The gripping means split wedge members 14a, 14b have inwardly facing wicker like teeth element 14d having wicker teeth peeks 14d$^1$ angled somewhat downwardly for grasping engagement with the coiled tubing CT interposed around the interior of the split wedge members 14a, 14b. An upper interior face 12-c-2 of the central housing member 12c receives the lowermost end 14e of the split wedge members 14a, 14b.

A pair of set screw members 12-c-3 and 12-c-4 are provided within companion bores within the central housing 12c for securing the coiled tubing CT within and between inner housing 11 and the outer housing 12, with a pair of elastomeric O-ring seal elements 12-c-5 and 12-c-6 positioned therebelow and within the central housing 12c to prevent fluid communication between the central housing 12c and the coiled tubing CT.

The apparatus 10 also contains an emergency release mechanism comprised of the lower housing member 12e, the locking means 13, a lock release means 14 and an inner fishing sleeve member 15. As shown in FIG. 2, the locking means 13 is comprised of a plurality of circumferentially extending collet fingers 13b whose ends 13c extend radially outwardly into a companion groove 15a in the inner fishing sleeve 15. The collet members 13b flex at joint 13-b-1 for flexing inwardly, upon release.

The finger elements 13c of the collect fingers 13b are maintained outwardly into receipt with the groove 15a by means of the lock release sleeve 16 being implaced interiorly of the lowermost end of the locking means 13 and being shearably secured by means of a shear pin 16d received within a bore 16e and extending into a profile 16d of the lock release sleeve 16.

Figure 4:
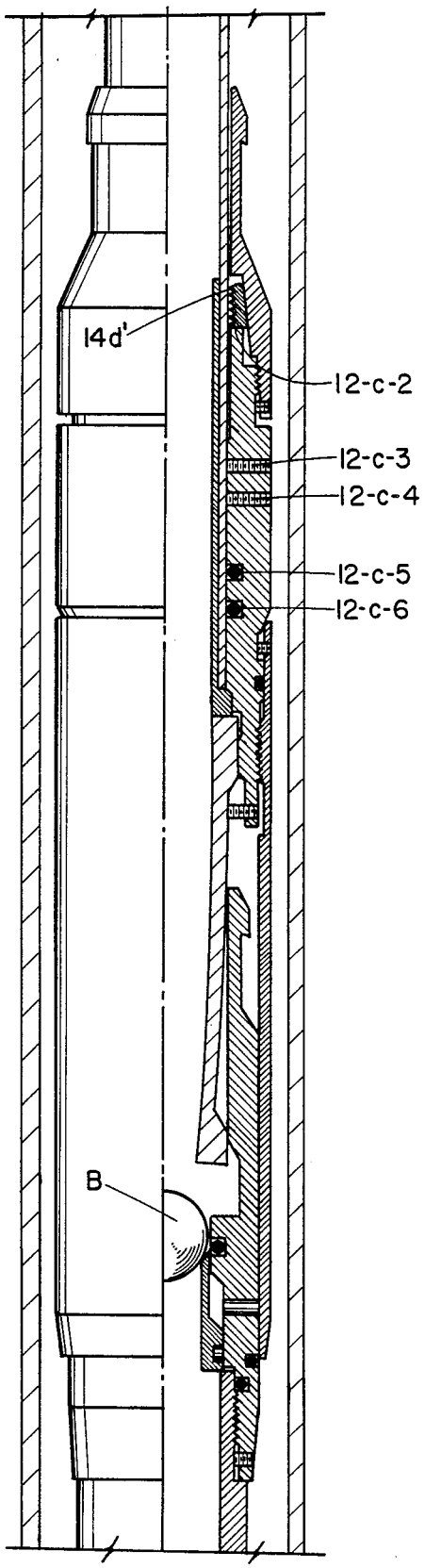
FIG. 4 is a sectional view of the apparatus, similar to that of FIG. 2, showing the releasing means activation.

The lock release 16 has at its upper end a profiled seat 16b for receipt of a ball element B (FIG. 4) to form a seat for application of hydraulic fluid thereacross to shear the pin 16d and permit the lock release 16 to shift downwardly until its lower face 16-c comes into no-go contact with the upper face TM-1 of a tubular member TM threadably secured at TM-2 to the lowermost end of the apparatus 10.

A second, interior fishing neck 15d is provided at the uppermost end of the inner fishing sleeve 15 and contoured similar to that of the neck 12-a-1 on the fishing neck element 12a for possible use in the event that the releasing mechanism is activated and it is desired to later go into the well to retrieve the balance of the tools by means of securing a conventional wireline or other tool to the neck 15d and retrieving same to the top of the well, after application of jarring, or other retrieving procedure.

OPERATION

Prior to running the apparatus 10 within the well W, the apparatus 10 is made up, but the split wedge members 14a, 14b and the fishing neck element 12a are not in place. The coiled tubing CT is run into the apparatus 10 in between the inner housing 11 and the central housing 12c until the lowermost end CT-1 of the coiled tubing CT abuts the shoulder 11a of the inner housing 11. Thereafter, the sets screws 12c-4 and 12-c-3 are immplaced within a central housing 12c and secured against the coiled tubing CT to resist rotational movement of the tubing CT relative to the apparatus 10. The upper and lower split wedge members 14a, 14b are placed around the coiled tubing CT with the lowermost face 14e riding against the upper face 12c2 of the central housing 12c. The tapered surfaces portions 12e', 12f of the fishing neck 12a will face the outer companion tapered surface 14c of the split wedge members 14a, 14b, and the wicker teeth 14d will abut against the outer surface of the coiled tubing CT.

The fishing neck element 12a (which previously has been run onto the coiled tubing CT past the lower end CT-1 thereof) now is secured around the coiled tubing CT and the split wedge members 14a, 14b and is secured at threads 12b to the central housing member 12c. As the apparatus 10 is suspended at the top of the well prior to introduction through the stuffing box, blowout preventors, or the like, at the top of the well for introduction through the production tubing PT and the casing C, tension will be defined through the coiled tubing CT. As such tension is encountered, the split wedge members 14a and 14b will be urged upwardly within the fishing neck element 12a. Such upward urging of the members 14a, 14b will be resisted by the wicker teeth 14d grasping and moving further into the coiled tubing CT until the taper between the split wedge members 14a, 14b and that defined by the surfaces 12f, 12g will move the wedge members 14a, 14b into further axial radial movement relative to the coiled tubing CT.

The inner housing 11 during such operation acts as a stabilizer relative to the coiled tubing CT, and resists the inner radial movement of the wedge members 14a, 14b toward the coiled tubing CT.

The inner housing 11, wedge members 14a, 14b, and fishing neck element 12a being made of a solid having a tensile strength exceeding that of the coiled tubing CT, it will be appreciated that the coiled tubing CT will break prior to failure of any of these components. Of course, other components in the apparatus 10 may have such increased tensile strength.

In the event that an auxiliary tool, which is secured by means for carrying the auxiliary tool at one end of the apparatus A, such as through threads TM-2 securing tubing member TM to the lowermost end of the apparatus 10, is stuck in the well the releasing means of the present invention may be activated. A ball B is pumped through or gravitated through the coiled tubing CT until it sealingly rests upon the seat 16b of the lock release 16. Thereafter, fluid pressure within the coiled tubing CT is increased to an amount which overcomes the shear strength of the shear pin 16d. As the pin 16d shears, the lock release 16 will be urged downwardly until its lower face 16c comes to rest upon the upper no-go end TM-1 of the tubing member TM. As the seat 16b passes the lowermost end of the collet fingers 13c, the collet members 13-b-1 will flex out of the groove 15a and will radially compress inwardly, thus freeing the collet sleeve 10, the lower housing member 12e, the central housing 12c, the fishing neck element 12a and the inner housing 11 to be separated from the portions of the apparatus 10 therebelow and carried to the top of the well by means of the coiled tubing CT.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Apparatus for securement onto one end of a continuous length of remedial tubing introduceable into a subterranean well and concentrically insertable through production tubing previously positioned within said well, said remedial tubing having a pre-determined tensile strength, said apparatus comprising:

(1) inner and outer cylindrical housing members having an opening therethrough for receipt of said one end of said remedial tubing therebetween;

(2) a first element of one of said housings having a first tapered surface therein, said first tapered surface decreasing in internal diameter from a first end away from said opening to a second end toward said opening; and (3) gripping means housed within said surface and having a second tapered surface in companion contoured relationship with said first tapered surface for engagement actuation relative to said remedial tubing and movable along said first tapered surface whereby tensile load applied through the remedial tubing and the decrease of the diameter of said first and second tapered surface will urge said gripping means into further radially axial engagement with said remedial tubing, said housings and said gripping means having a tensile strength in excess of the tensile strength of the remedial tubing.

2. The apparatus of claim 1 wherein said gripping means comprises a pair of split wedges with wicker members thereon facing said remedial tubing.

3. The apparatus of claim 1 or 2 further comprising means for carrying an auxiliary tool at one end of said apparatus for insertion into said well.

4. The apparatus of claim 1 or 2 further comprising means for carrying an auxiliary tool at one end of said apparatus for insertion into said well, and means for hydraulically releasing said apparatus from said auxiliary tool.

5. The apparatus of claim 1 or 2 further comprising means for carrying an auxiliary tool at one end of said apparatus for insertion into said well, and means for hydraulically releasing said apparatus from said auxiliary tool, said hydraulic releasing means comprising:

a third cylindrical housing member disposed between said first and second housing members; locking means carryable between at least one of the first, second or third housing members and selectively releasably interengagable with:

(a) one of the first and second housing members; and (b) the third housing member; and means for releasing said locking means from said interengagement.

6. The apparatus of claim 1 or 2 further comprising means for carrying an auxiliary tool at one end of said apparatus for insertion into said well, and means for hydraulically releasing said apparatus from said auxiliary tool, said hydraulic releasing means comprising:

a third cylindrical housing member disposed between said first and second housing members; locking means carryable between at least one of the first, second or third housing members and selectively releasably interengagable with:

(a) one of the first and second housing members; and (b) the third housing member; and means for releasing said locking means from said interengagement, said releasing means comprising a sleeve shiftable from one position wherein the locking means are in interengaged position to another position wherein the locking means are released.

7. The apparatus of claim 1 or 2 further comprising means for carrying an auxiliary tool at one end of said apparatus for insertion into said well, and means for hydraulically releasing said apparatus from said auxiliary tool, said hydraulic releasing means comprising:

a third cylindrical housing member disposed between said first and second housing members; locking means carryable between at least one of the first, second or third housing members and selectively releasably interengagable with:

(a) one of the first and second housing members; and (b) the third housing member; and means for releasing said locking means from said interengagement, said releasing means comprising a sleeve shiftable from one position wherein the locking means are in interengaged position to another position, and a sealing means at one end of said releasing means for selectively receiving a ball member thereon.

8. A method of completing a wellbore having a deviated configuration including an entry portion communicating with a curved portion extending downwardly in the well from said entry portion and a generally linear end portion traversable with a production formation, comprising the steps of:

(1) affixing onto one end of a continuous length of remedial tubing introduceable into said wellbore and concentrically insertable through said production tubing previously positioned within said well through an entry portion communicating with said curved portion extending downwardly in the well, a securement apparatus comprising:

(a) inner and outer cylindrical housing members having an opening therethrough for receipt of said one end of said remedial tubing therebetween;

(b) a first element of one of said housings having a first tapered surface therein, said first tapered surface decreasing in internal diameter from a first end away from said opening to a second end toward said opening; and (c) gripping means housed within said surface and having a second tapered surface in companion contoured relationship with said first tapered surface for engagement with said remedial tubing and movable along said first tapered surface whereby tensile load applied through the remedial tubing and the decrease of the diameter of said first and second tapered surface will urge said gripping means into further radially axial engagement with said remedial tubing, said housings and said gripping means having a tensile strength in excess of the tensile strength of the remedial tubing;

(2) causing a tensile load to be applied through the remedial tubing to urge said gripping means into gripping engagement with said one end of the continuous length of remedial tubing; and (3) running the aforementioned continuous length of remedial tubing with said securement apparatus affixed thereon into the wellbore and manipulating the conduit to facilitate passage of the conduit through the curved portion of the wellbore.

9. The method of claim 8 wherein said gripping means comprises a pair of split wedges with wicker members thereon facing said remedial tubing.

10. The method of claim 8 or 9 wherein said apparatus further comprises means for carrying an auxiliary tool at one end of said apparatus for insertion into said well.

11. The method of claim 8 or 9 wherein said apparatus further comprises means for carrying an auxiliary tool at one end of said apparatus for insertion into said well, and means for hydraulically releasing said apparatus from said auxiliary tool.

12. The apparatus of claim 8 or 9 wherein said apparatus further comprises means for carrying an auxiliary tool at one end of said apparatus for insertion into said well, and means for hydraulically releasing said apparatus from said auxiliary tool, said hydraulic releasing means comprising:

a third cylindrical housing member disposed between said first and second housing members; locking means carryable between at least one of the first, second or third housing members and selectively releasably interengagable with:

(a) one of the first and second housing members; and (b) the third housing member; and means for releasing said locking means from said interengagement.

13. The apparatus of claim 8 or 9 wherein said apparatus further comprises means for carrying an auxiliary tool at one end of said apparatus for insertion into said well, and means for hydraulically releasing said apparatus from said auxiliary tool, said hydraulic releasing means comprising:

a third cylindrical housing member disposed between said first and second housing members; locking means carryable between at least one of the first, second or third housing members and selectively releasably interengagable with:

(a) one of the first and second housing members; and (b) the third housing member; and means for releasing said locking means from said interengagement, said releasing means comprising a sleeve shiftable from one position wherein the locking means are in interengaged position to another position where the locking means are released.

14. The apparatus of claim 8 or 9 wherein said apparatus further comprises means for carrying an auxiliary tool at one end of said apparatus for insertion into said well, and means for hydraulically releasing said apparatus from said auxiliary tool, said hydraulic releasing means comprising:

a third cylindrical housing member disposed between said first and second housing members; locking means carryable between at least one of the first, second or third housing members and selectively releasably interengagable with:

(a) one of the first and second housing members; and (b) the third housing member; and means for releasing said locking means from said interengagement, said releasing means comprising a sleeve shiftable from one position wherein the locking means are in interengaged position to another position, and a sealing means at one end of said releasing means for selectively receiving a ball member thereon.

15. An apparatus for completing a wellbore having a deviated configuration including an initial substantially vertical entry portion communicating with a curved portion which in turn communicates with a substantially horizontal portion traversing a production formation, comprising:

(1) means for securement onto one end of a continuous length of remedial tubing introduceable into said wellbore through production tubing previously positioned within said substantially horizontal portion traversing a production formation, said remedial tubing having a pre-determined tensile strength;

(2) inner and outer cylindrical housing members having an opening therethrough for receipt of said one end of said remedial tubing therebetween;

(3) a first element of one of said housings having a first tapered surface therein, said first tapered surface decreasing in internal diameter from a first end away from said opening to a second end toward said opening; and (4) gripping means housed within said surface and having a second tapered surface in companion contoured relationship with said first tapered surface for engagement actuation relative to said remedial tubing and movable along said first tapered surface whereby tensile load applied through the remedial tubing and the decrease of the diameter of said first and second tapered surface will urge said gripping means into further radially axial engagement with said remedial tubing, said housings and said gripping means having a tensile strength in excess of the tensile strength of the remedial tubing.

16. The apparatus of claim 15 wherein said gripping means comprises a pair of split wedges with wicker members thereon facing said remedial tubing.

17. The apparatus of claim 15 or 16 further comprising means for carrying an auxiliary tool at one end of said apparatus for insertion into said well.

18. The apparatus of claim 15 or 16 further comprising means for carrying an auxiliary tool at one end of said apparatus for insertion into said well, and means for hydraulically releasing said apparatus from said auxiliary tool.

19. The apparatus of claim 15 or 16 further comprising means for carrying an auxiliary tool at one end of said apparatus for insertion into said well, and means for hydraulically releasing said apparatus from said auxiliary tool, said hydraulic releasing means comprising:

a third cylindrical housing member disposed between said first and second housing members; locking means carryable between at least one of the first, second or third housing members and selectively releasably interengagable with:

(a) one of the first and second housing members; and (b) the third housing member; and means for releasing said locking means from said interengagement.

20. The apparatus of claim 15 or 16 further comprising means for carrying an auxiliary tool at one end of said apparatus for insertion into said well, and means for hydraulically releasing said apparatus from said auxiliary tool, said hydraulic releasing means comprising:

a third cylindrical housing member disposed between said first and second housing members; locking means carryable between at least one of the first, second or third housing members and selectively releasably interengagable with:

(a) one of the first and second housing members; and (b) the third housing member; and means for releasing said locking means from said interengagement, said releasing means comprising a sleeve shiftable from one position wherein the locking means are in interengaged position to another position where the locking means are released.

21. The apparatus of claim 15 or 16 further comprising means for carrying an auxiliary tool at one end of said apparatus for insertion into said well, and means for hydraulically releasing said apparatus from said auxiliary tool, said hydraulic releasing means comprising:

a third cylindrical housing member disposed between said first and second housing members; locking means carryable between at least one of the first, second or third housing members and selectively releasably interengagable with:

(a) one of the first and second housing members; and (b) the third housing member; and means for releasing said locking means from said interengagement, said releasing means comprising a sleeve shiftable from one position wherein the locking means are in interengaged position to another position, and a sealing means at one end of said releasing means for selectively receiving a ball member thereon.

22. Apparatus for securement onto the lowermost end of a continuous length of remedial tubing introducable into a subterranean well and concentrically insertable through production tubing previously positioned within said well, said remedial tubing having a predetermined tensile strength, said apparatus comprising:

(1) first means for radial axial engagement of said one end of said remedial tubing; and (2) second means whereby tensile load applied through the remedial tubing and said apparatus urge said first means into further radial axial engagement with said remedial tubing, said first and second means having a tensile strength in excess of the tensile strength of the remedial tubing.

23. The apparatus of claim 22 further comprising means for hydraulically releasing said apparatus from said remedial tubing.

* * * * *